US011428027B2

(12) United States Patent
Huang

(10) Patent No.: US 11,428,027 B2
(45) Date of Patent: Aug. 30, 2022

(54) LOCKING MECHANISM AND LOCKING BODY ASSEMBLY FOR MAGNETIC LOCK, AND THE MAGNETIC LOCK

(71) Applicant: MAYAPPLE BABY LLC, Brooklyn, NY (US)

(72) Inventor: Jianying Huang, Brooklyn, NY (US)

(73) Assignee: Mayapple Baby LLC, Brooklyn, NY (US)

( * ) Notice: Subject to any disclaimer, the term of this patent is extended or adjusted under 35 U.S.C. 154(b) by 1116 days.

(21) Appl. No.: 16/004,976

(22) Filed: Jun. 11, 2018

(65) Prior Publication Data

US 2018/0363328 A1 Dec. 20, 2018

Related U.S. Application Data

(63) Continuation-in-part of application No. 29/607,796, filed on Jun. 16, 2017, now Pat. No. Des. 837,034,
(Continued)

(51) Int. Cl.
*E05B 47/00* (2006.01)
*E05B 65/46* (2017.01)
(Continued)

(52) U.S. Cl.
CPC ..... *E05B 47/0045* (2013.01); *E05B 47/004* (2013.01); *E05B 57/00* (2013.01);
(Continued)

(58) Field of Classification Search
CPC .. E05B 47/0045; E05B 57/00; E05B 65/0014; E05B 65/46; E05B 47/0038;
(Continued)

(56) References Cited

U.S. PATENT DOCUMENTS 2,970,857 A * 2/1961 Squire ..... E05C 19/16 292/251.5
3,388,938 A * 6/1968 Peterson ..... E05C 7/04 292/177

(Continued)

FOREIGN PATENT DOCUMENTS

| | | |
|---|---|---|
| CN | 201695784 U | 1/2011 |
| CN | 107178257 A | 9/2017 |
| WO | 2018/028028 A1 | 2/2018 |

OTHER PUBLICATIONS

English translation of Appl. No. CN 201695784 U dated Jan. 5, 2011.

(Continued)

*Primary Examiner* — Christine M Mills
*Assistant Examiner* — Faria F Ahmad
(74) *Attorney, Agent, or Firm* — Fox Rothschild LLP

(57) ABSTRACT

The present invention relates to a locking mechanism for a magnetic lock and including a locking body assembly. The locking mechanism includes a lock latch and a slide bar switch that move between an active and non-active positions. The lock latch cannot move freely in the active position, but can in the non-active position. The lock latch receives a magnet, and can move freely through magnetic force action. The locking body assembly includes a locking body and a locking plate. The locking body has a housings that form a cavity. When the locking mechanism and lock latch are fixed in the cavity, a hook portion of the lock latch can extend out of or retract into the cavity as the lock latch pivots, thereby engaging or disengaging with the locking plate, and either locking or unlocking the latch. The magnetic lock includes a key and the locking body assembly.

20 Claims, 6 Drawing Sheets

Related U.S. Application Data and a continuation-in-part of application No. 29/607,814, filed on Jun. 16, 2017, now Pat. No. Des. 830,314, and a continuation-in-part of application No. 29/607,803, filed on Jun. 16, 2017, now Pat. No. Des. 840,212, and a continuation-in-part of application No. 29/607,800, filed on Jun. 16, 2017, now Pat. No. Des. 937,662, and a continuation-in-part of application No. 29/607,811, filed on Jun. 16, 2017, now Pat. No. Des. 818,796, and a continuation-in-part of application No. 29/607,806, filed on Jun. 16, 2017, now Pat. No. Des. 842,680.

(60) Provisional application No. 62/528,262, filed on Jul. 3, 2017.

(51) Int. Cl.

| | |
|---|---|
| ***E05B 57/00*** | (2006.01) |
| ***E05B 65/00*** | (2006.01) |
| ***E05C 3/00*** | (2006.01) |
| ***E05B 65/44*** | (2006.01) |

(52) U.S. Cl.

CPC ..... *E05B 65/0014* (2013.01); *E05B 65/46* (2013.01); *E05B 47/0038* (2013.01); *E05B 65/44* (2013.01); *E05C 3/006* (2013.01); *Y10T 292/0911* (2015.04); *Y10T 292/0945* (2015.04); *Y10T 292/0948* (2015.04); *Y10T 292/1043* (2015.04); *Y10T 292/1075* (2015.04); *Y10T 292/1078* (2015.04); *Y10T 292/11* (2015.04); *Y10T 292/68* (2015.04)

(58) Field of Classification Search

CPC ..... E05B 47/004; E05B 65/44; E05C 3/006; Y10T 292/0911; Y10T 292/0945; Y10T 292/0948; Y10T 292/1043; Y10T 292/1075; Y10T 292/1078; Y10T 292/68; Y10T 292/11

USPC ..... 70/276

See application file for complete search history.

(56) References Cited

U.S. PATENT DOCUMENTS

| | | | | | |
|---|---|---|---|---|---|
| 3,563,587 | A * | 2/1971 | Hughes | E05C 3/00 | 292/194 |
| 3,782,147 | A * | 1/1974 | Hallmann | E05B 47/0042 | 70/276 |
| 3,785,188 | A * | 1/1974 | Drathschmidt | E05B 17/142 | 70/276 |
| 3,831,986 | A * | 8/1974 | Kobayashi | E05B 47/0038 | 292/201 |
| 4,134,608 | A | 1/1979 | Pool | | |
| D251,584 | S | 4/1979 | Sorensen | | |
| D261,858 | S | 11/1981 | Lassiter | | |
| D266,395 | S | 10/1982 | Miller | | |
| D286,769 | S | 11/1986 | Gepner et al. | | |
| D292,868 | S | 11/1987 | Cheng | | |
| D293,765 | S | 1/1988 | Miles et al. | | |
| 4,758,015 | A | 7/1988 | Pixley | | |
| 4,848,812 | A | 7/1989 | Slaughter | | |
| 4,919,464 | A * | 4/1990 | Richards | E05B 47/0038 | 292/201 |
| 5,076,623 | A * | 12/1991 | Richards | E05B 47/0038 | 292/251.5 |
| 5,188,405 | A * | 2/1993 | Maccaferri | E05B 47/004 | 292/204 |
| D339,056 | S | 9/1993 | Black | | |
| D349,528 | S | 8/1994 | Ruszkai | | |
| 5,348,386 | A | 9/1994 | Grass | | |
| D351,781 | S | 10/1994 | DeWitt | | |
| 5,485,733 | A * | 1/1996 | Hoffman | E05B 47/004 | 70/276 |
| 5,653,134 | A * | 8/1997 | Lee | E05B 13/005 | 292/169.18 |
| 6,000,735 | A * | 12/1999 | Jourdenais | E05B 47/004 | 292/238 |
| D421,247 | S | 2/2000 | Hoshino | | |
| D442,463 | S | 5/2001 | Tieu et al. | | |
| D457,113 | S | 5/2002 | Zapushek et al. | | |
| 6,506,985 | B2 | 1/2003 | Konda | | |
| D471,426 | S | 3/2003 | Weinerman et al. | | |
| D471,427 | S | 3/2003 | Weinerman et al. | | |
| D474,675 | S | 5/2003 | Simon et al. | | |
| D484,101 | S | 12/2003 | Long et al. | | |
| D494,840 | S | 8/2004 | Senn | | |
| D495,236 | S | 8/2004 | Gurzenda | | |
| D495,666 | S | 9/2004 | Wong et al. | | |
| 6,841,749 | B1 | 1/2005 | Radosavljevic et al. | | |
| D549,080 | S | 8/2007 | Killins | | |
| D557,667 | S | 12/2007 | Kawamura et al. | | |
| D558,024 | S | 12/2007 | Tremble et al. | | |
| D558,690 | S | 1/2008 | Anderson, Jr. et al. | | |
| D563,900 | S | 3/2008 | Tang | | |
| D587,558 | S | 3/2009 | Samowski | | |
| D609,551 | S | 2/2010 | Gibbs | | |
| 7,735,943 | B2 | 6/2010 | Hottmann | | |
| 7,740,429 | B2 | 6/2010 | Marmur | | |
| D635,436 | S | 4/2011 | Barton | | |
| D662,392 | S | 6/2012 | Main | | |
| D667,286 | S | 9/2012 | Wu | | |
| D678,221 | S | 3/2013 | Lukito | | |
| 8,397,546 | B2 * | 3/2013 | Varney | E05C 3/124 | 70/276 |
| D691,964 | S | 10/2013 | Cuche | | |
| 8,899,636 | B2 * | 12/2014 | Fitzgerald | E05B 15/0053 | 292/251.5 |
| 8,938,998 | B2 * | 1/2015 | Haber | E05B 47/0038 | 70/95 |
| D731,441 | S | 6/2015 | Cloran et al. | | |
| D760,575 | S | 7/2016 | Werner | | |
| D764,891 | S | 8/2016 | Gokcebay et al. | | |
| 9,447,618 | B2 | 9/2016 | Albers et al. | | |
| D777,558 | S | 1/2017 | Magee | | |
| D789,770 | S | 6/2017 | Reeb et al. | | |
| D798,688 | S | 10/2017 | Yong et al. | | |
| D807,133 | S | 1/2018 | Tunney | | |
| D809,366 | S | 2/2018 | Gokcebay | | |
| 10,798,830 | B2 * | 10/2020 | Hwang | E05C 3/04 | |
| D907,454 | S * | 1/2021 | Marsden | D8/31 | |
| D907,460 | S * | 1/2021 | Marsden | D8/343 | |
| 2007/0113605 | A1 * | 5/2007 | Lopez | E05B 47/0044 | 70/276 |
| 2007/0249198 | A1 | 10/2007 | Nakase et al. | | |
| 2012/0067090 | A1 * | 3/2012 | Varney | E05B 65/46 | 70/81 |
| 2013/0313090 | A1 | 11/2013 | Wu et al. | | |
| 2014/0008192 | A1 | 1/2014 | Christophy et al. | | |
| 2014/0190805 | A1 | 7/2014 | Chou et al. | | |
| 2019/0257121 | A1 * | 8/2019 | Tubby | E05B 47/0045 | |
| 2021/0079689 | A1 * | 3/2021 | Marsden | E05B 65/0014 | |
| 2021/0189763 | A1 * | 6/2021 | Jean | E05B 55/00 | |

OTHER PUBLICATIONS

English translation of Appl. No. CN 107178257 A dated Sep. 19, 2017.

English translation of Appl. No. WO 2018/028028 A1 dated Feb. 15, 2018.

* cited by examiner

LOCKING MECHANISM AND LOCKING BODY ASSEMBLY FOR MAGNETIC LOCK, AND THE MAGNETIC LOCK

CROSS-REFERENCE TO RELATED APPLICATIONS

This application is a continuation-in-part of each of U.S. application Ser. Nos. 29/607,796, 29/607,800, 29/607,803, 29/607,806, 29/607,811, now Pat. No. D818,796 and 29/607,814, each of which was filed Jun. 16, 2017, and claims the benefit of U.S. patent application 62/528,262 filed Jul. 3, 2017. The entire content of each application is expressly incorporated herein by reference thereto.

FIELD OF THE INVENTION

The present invention relates to a locking mechanism for a magnetic lock, a locking body assembly for the magnetic lock, and the magnetic lock, which is used to lock furniture such as a drawer or cabinet.

BACKGROUND OF THE INVENTION

In daily life, furniture with drawers or cabinets are usually needed to store various articles. In the case of daily life with children at home, many children are interested in articles placed in the furniture, so they like opening drawers or cabinets to turn out the articles stored therein. However, articles stored in the furniture might be eaten or used by mistake by children who have no discerning capability and therefore causes undesired damages, so a lock usually is needed to lock the furniture to prevent children from opening it randomly. However, currently most furniture available in the market are not pre-provided with locks to lock drawers or cabinets, so locks need to be provided additionally. As for the mounting of conventional locks, the furniture usually needs to be drilled a through hole, a lock is mounted in the through hole, and a key hole of the lock is exposed out of an outer surface of the furniture. This destroys the overall appearance of the furniture, and additionally, the lock mounted in the conventional manner does not facilitate reuse and cause higher costs.

To this end, it is desirable to provide a magnetic lock capable of overcoming drawbacks of a conventional lock.

SUMMARY OF THE INVENTION

The present invention now provides a novel locking mechanism for a magnetic lock and a locking body assembly for the magnetic lock. The present invention further provides a magnetic lock having the locking body assembly.

The magnetic lock according to the present invention can be assembled and disassembled for use many times.

The magnetic lock according to the present invention avoids the complicated operation of drilling a hole on a surface of the furniture for mounting, and instead provides a convenient installation. Furthermore, as the magnetic lock is characterized by being mounted in the furniture in a concealed manner, it may be mounted without affecting the aesthetics and pleasant appearance of the furniture.

The locking mechanism for the magnetic lock according to the present invention comprises a lock latch having a first magnet, a slide bar switch linked with the lock latch, and a second magnet. When a first end of the slide bar switch is pressed, the lock latch disengages from the slide bar switch, the locking mechanism is in a non-active state, the lock latch can pivot due to a magnetic force action between the first magnet and the second magnet, and the magnetic lock can be locked and unlocked; when a second end of the slide bar switch is pressed, the locking mechanism is in an active state, the slide bar switch abuts and presses the lock latch and makes the lock latch pivot reversely against the magnetic force action between the first magnet and the second magnet, and the magnetic lock remains at the unlocked position.

The first end of the slide bar switch of the locking mechanism preferably includes a blocking member such that pressing of the first end of the slide bar switch provides the blocking member in a position where it interferes with the movement of the lock latch to maintains the lock latch in the inactive position so that the magnetic lock cannot be locked. Additionally, pressing of the second end of the slide bar switch moves the blocking member out of interference with the movement of the lock latch so that the lock latch is enabled to move to the active position to lock the magnetic lock. Also, when the blocking member is out of interference with the movement of the lock latch and the lock latch locks the magnetic lock, the magnetic lock can be opened using an external key that includes a magnet.

According to a preferred implementation of the present invention, the lock latch is an approximately L-shaped member.

According to a preferred implementation of the present invention, the lock latch comprises a first body, a second body and a pivot shaft between the first body and the second body.

According to a preferred implementation of the present invention, the lock latch is provided with a hook portion at a first end, provided with a protruding rod at a second end, and provided with a receiving portion for receiving the first magnet adjacent to the second end.

According to a preferred implementation mode of the present invention, the slide bar switch comprises a slide bar portion and a wedge-shaped portion located in the middle of the slide bar portion.

According to a preferred implementation of the present invention, when the first end of the slide bar switch is pressed, as the slide bar portion of the slide bar switch slides, the wedge-shaped portion gradually disengages from the rod, and the attraction force between the second magnet and the first magnet enables the lock latch to pivot about the pivot shaft.

According to a preferred implementation of the present invention, when the second end of the slide bar switch is pressed, as the slide bar portion of the slide bar switch slides, the wedge-shaped portion abuts against the rod and gradually presses downward, thereby overcoming the attraction force between the second magnet and the first magnet, so that the lock latch is enabled to pivot about the pivot shaft reversely.

The locking body assembly for the magnetic lock according to the present invention comprises a locking body and a locking plate, the locking body comprises a locking body housing, the locking plate is disposed outside the locking body housing, and the locking mechanism according to any of the preceding embodiments is disposed in the locking body housing.

According to a preferred implementation of the present invention, the locking body has a mounting base.

According to a preferred implementation of the present invention, the mounting base is provided with a receiving indentation in the middle, and provided with a stop portion nearby the receiving indentation.

According to a preferred implementation of the present invention, the first magnet and the second magnet are disc-shaped magnets.

According to a preferred implementation of the present invention, the receiving indentation is a blind hole or through hole.

According to a preferred implementation of the present invention, the locking body housing comprises a slide bar switch hole and a pivot shaft hole for engaging with the pivot shaft.

According to a preferred implementation of the present invention, the locking body housing comprises a first housing and a second housing, and the first housing and the second housing can be combined with each other to form a cavity for receiving the locking mechanism.

According to a preferred implementation of the present invention, a groove for receiving a second magnet is provided in the locking body housing, and the groove is adjacent to the pivot shaft hole.

According to a preferred implementation of the present invention, the locking plate is provided with a recess or rod for engagement.

According to a preferred implementation of the present invention, the locking body assembly is mounted in an interior of the furniture.

According to a preferred implementation of the present invention, a base surface of the locking plate is mounted on a surface in the interior of the furniture, and the locking body is, via its mounting base, mounted on a plane at a certain angle relative to the locking plate.

According to a preferred implementation of the present invention, the angle is a right angle. According to a preferred implementation of the present invention, the first housing, second housing and locking plate can be mounted via screw connection or adhesion.

According to a preferred implementation of the present invention, the lock latch is provided with a reinforcing rib at the hook portion.

The magnetic lock according to the present invention comprises a key and the aforesaid locking body assembly.

According to a preferred implementation of the present invention, the key comprises a key magnet.

According to a preferred implementation of the present invention, the key further comprises a gripping portion and a base for receiving the key magnet.

BRIEF DESCRIPTION OF DRAWINGS

Preferred features of the invention are now described in connection with the appended drawing figures, wherein.

DETAILED DESCRIPTION OF THE INVENTION

Hereunder, a locking mechanism for a magnetic lock, a locking body assembly for the magnetic lock, and a magnetic lock including the locking body assembly according to the present invention will be described in detail with reference to figures. The following only describes preferred embodiments of the present invention. Those skilled in the art may, on the basis of the preferred embodiments, envisage other modes for implementing the present invention. Other manners also fall within the scope of the present invention.

Terms about directions appearing in the following depictions, for example, "front", "rear", "left", "right", "up" and "down", are with respect to the directions shown in the figures.

The magnetic lock according to the present invention comprises a locking body assembly switchable between an unlocked state and a locked state, and a key for unlocking the locked state of the locking body assembly.

Figure 1:
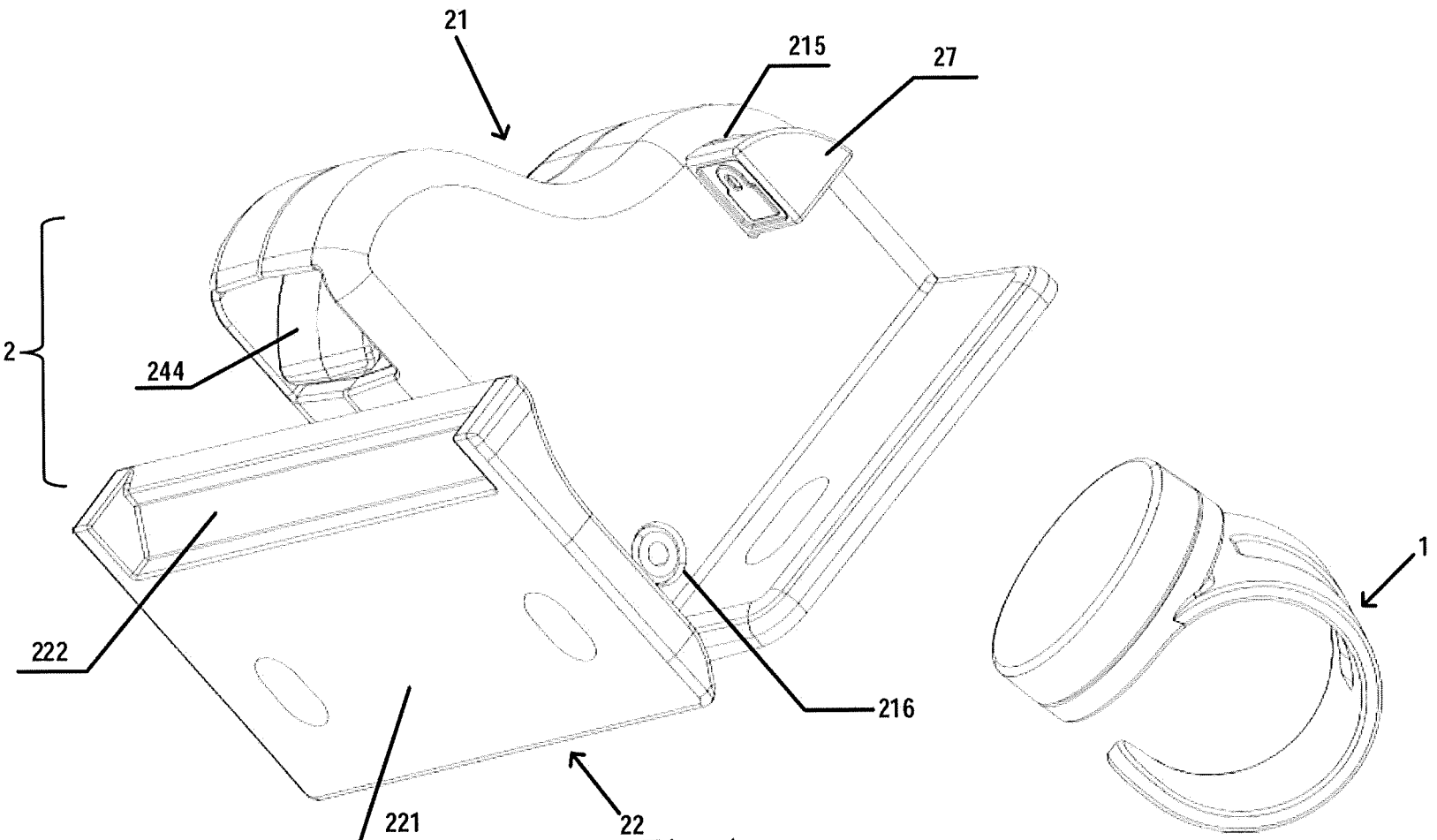
FIG. 1 illustrates a schematic view of a magnetic lock according to an embodiment of the present invention, showing a locking body assembly and a key, wherein a hook portion of a locking body of the locking body assembly does not engage with a locking plate of the locking body assembly.
Figure 2:
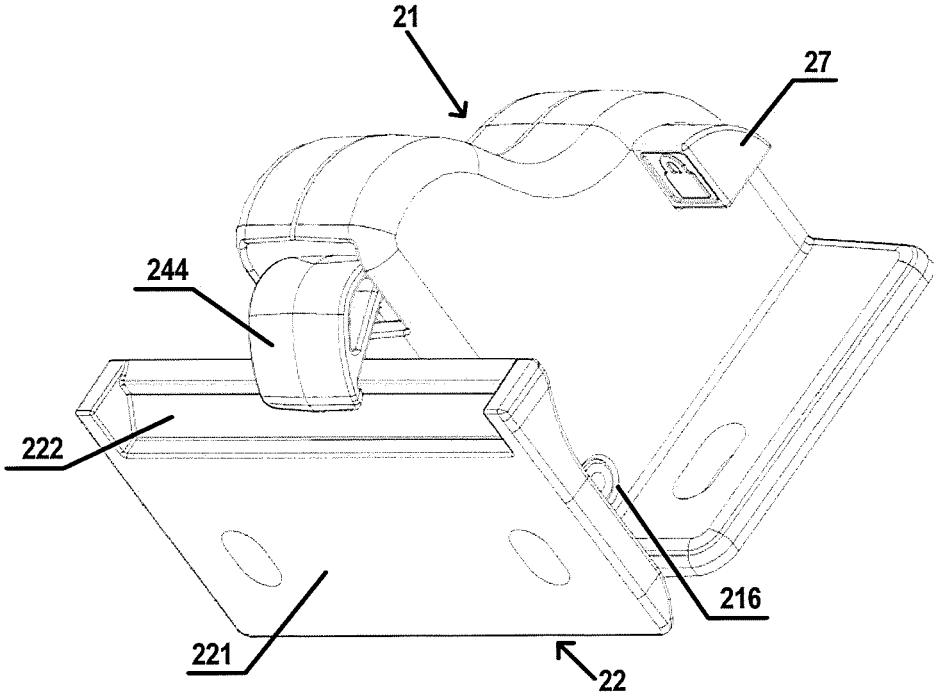
FIG. 2 shows another schematic view of the magnetic lock of FIG. 1, wherein the hook portion of the locking body of the locking body assembly engages with the locking plate of the locking body assembly.

FIG. 1 illustrates a schematic view of a magnetic lock according to an embodiment of the present invention, comprising a locking body assembly 2 and a key 1, wherein the locking body assembly 2 comprises a locking body 21 and a locking plate 22. In a state shown in FIG. 1, the locking body 21 does not engage with the locking plate 22, namely, the locking body assembly 2 is in an unlocked state. FIG. 2 shows another schematic view of the magnetic lock of FIG. 1, wherein the locking body 21 of the locking body assembly 2 engages with the locking plate 22 of the locking body assembly 2 to achieve the locking, namely, the locking body assembly 2 is in a locked state.

Figure 3:
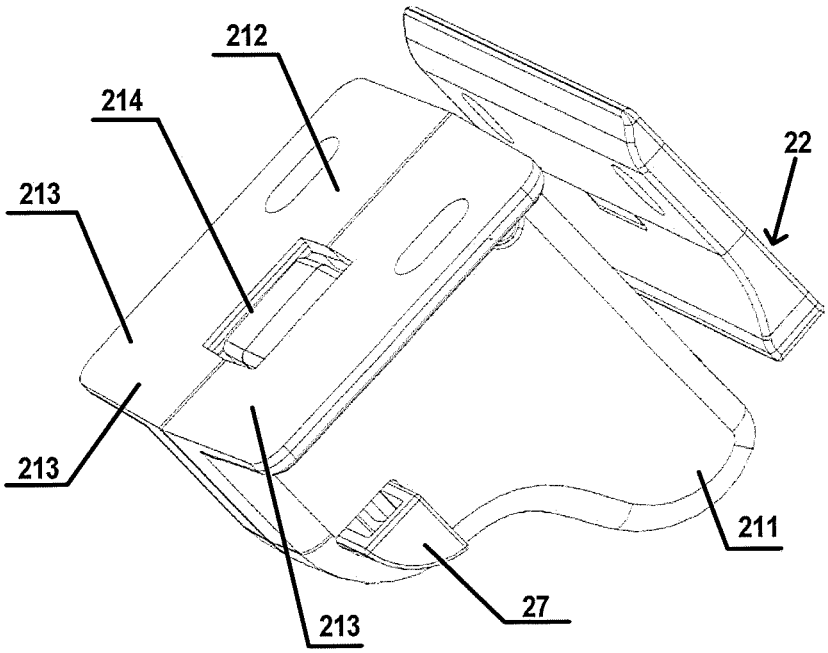
FIG. 3 shows a perspective view of a locking body assembly according to an embodiment of the present invention.

In use, the locking body assembly 2 may be mounted in an interior of the furniture such as a drawer or cabinet, wherein a base surface 221 of the locking plate 22 may be mounted on a surface in the interior of the drawer or cabinet, the locking body 21 is, via its mounting base 213 as shown in FIG. 3, mounted on a plane at a certain angle relative to the locking plate 22, and the angle is approximately a right angle as shown in the figure. When a hook portion of the locking body 21 extends out of a locking body housing to engage with the locking plate 22, locking is implemented, whereupon the furniture such as the drawer or cabinet cannot be opened (see FIG. 2); when the key 1 with a magnet approaches the magnetic lock from outside the furniture such as drawer or cabinet, the hook portion retracts in the locking body housing due to magnetic force action between the magnet of the key 1 and the magnet in the locking body 21, unlocking is implemented, whereupon the furniture such as drawer or cabinet may be opened, as shown in FIG. 1.

The locking body assembly 2 is described in detail with reference to the figures.

FIG. 3 shows a perspective view of a locking body assembly 2 according to an embodiment of the present invention. As stated above, the locking body assembly 2 comprises a locking body 21 and a locking plate 22. Specifically, the locking body 21 comprises a locking body housing, the locking body housing comprises a first housing 211 and a second housing 212, and the first housing 211 and the second housing 212 can be combined with each other to form a cavity. The first housing 211 and the second housing 212 may be made of any suitable material such as plastic, and their shapes are not particularly limited so long as their internal space can receive relevant parts. The first housing 211 and the second housing 212 are preferably in a mirror symmetry configuration. To match the parts received in the cavity, the first housing 211 and the second housing 212 may respectively have a slide bar switch hole 215, a pivot shaft hole 216 and the like, which will be described in detail respectively below. In addition, the first housing 211 and the second housing 212 respectively have a mounting base 213 which enables the locking body 21 to be mounted on a surface of the furniture. In the embodiment shown in FIG. 3, the mounting base 213, as shown, is provide with a mounting hole for connection with a furniture panel via a screw. Additionally or alternatively, the mounting base 213 may also be fixed on the furniture panel or furniture door by adhesion, such as by an adhesive tape or adhesive formulation that can securely attach the base to the panel or door. In addition, for example, a receiving indentation 214 may be provided at a central position of the mounting base 213 as shown in FIG. 3, and it also will be described below in detail. The locking plate 22 may be provided with a structure such as a recess 222 or bar for engagement, to achieve engagement with a mating member (e.g., the hook portion of the locking body assembly 2) for a locking function.

Figure 4:
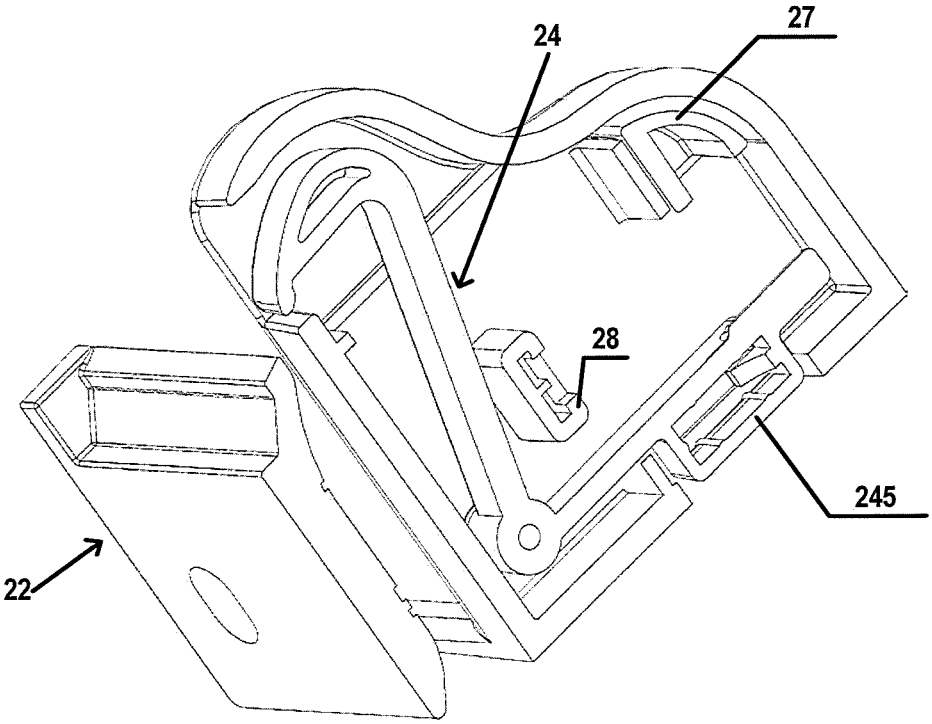
FIG. 4 shows a cross-sectional view of a locking body assembly according to an embodiment of the present invention.
Figure 5:
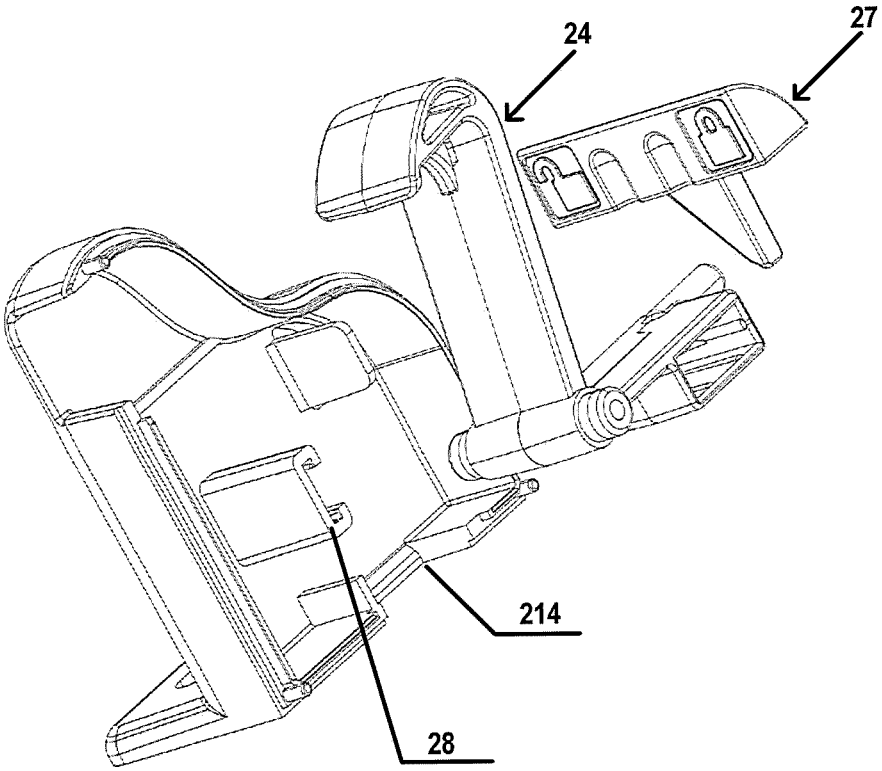
FIG. 5 shows a partially exploded view of the locking body assembly according to the present invention.

Reference is made to FIG. 4 that shows a cross-sectional view of a locking body assembly 2 according to the present invention, and FIG. 5 that shows a partially exploded view of the locking body assembly 2 according to the present invention. The locking body assembly 2 further comprises a locking mechanism in the cavity of the locking body 21. The locking mechanism comprises a lock latch 24 and a slide bar switch 27 linkable with the lock latch 24, and switching of the locking mechanism between an active state and a non-active state may be achieved by virtue of movement of the slide bar switch 27. In the active state of the locking mechanism, the position of the slide bar switch 27 can retain the hook portion 244 at one end of the lock latch 24 at a retracted position through linkage with the lock latch 24, so that the locking body assembly 21 will not form engagement with the locking plate 22 through the hook portion 244 of the lock latch 24 and thereby the locking body assembly 2 is always retained in the unlocked state. The advantage of so doing lies in that when children are not at home and the locking body assembly need not be locked, the unlocked state of the locking body assembly is maintained so that the furniture such as the drawer or cabinet can be conveniently opened and used without using a key. In the non-active state of the locking mechanism, the position of slide bar switch 27 disengages from linkage with the lock latch 24, the hook portion 244 of the lock latch 24 can extend out of the locking body housing of the locking body 21 and thereby implements engagement with the recess 222 of the locking plate 2 to lock. When the children are at home, the locking mechanism is made in the non-active state through the slide bar switch 27, the locking body assembly 2 is permitted to lock and the locking is released by using the key 1.

The lock latch 24 and the slide bar switch 27 are described below in detail with reference to FIG. 6 and FIG. 7.

Figure 6:
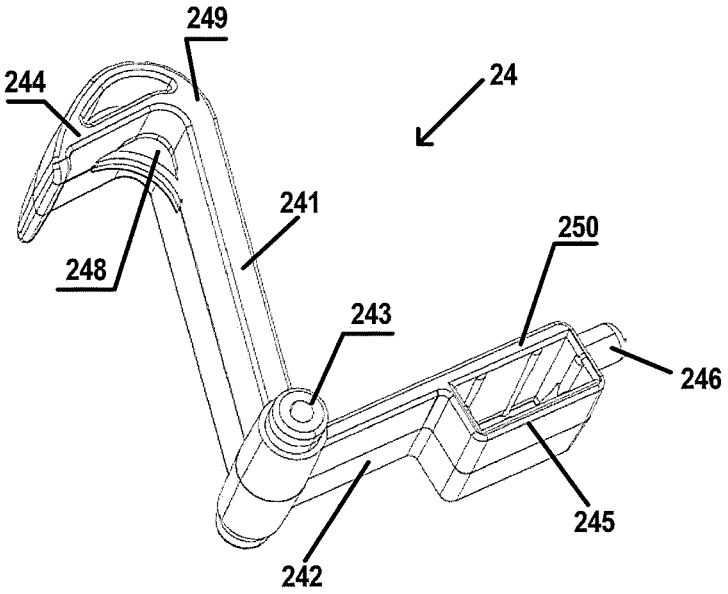
FIG. 6 shows a perspective view of a lock latch of the locking body assembly according to the present invention.

Referring to FIG. 6, the lock latch 24 according to the embodiment of the present invention is an approximately L-shaped member as viewed from a side. The lock latch 24 comprises a first body 241, a second body 242 and a pivot shaft 243 between the first body 241 and the second body 242, the pivot shaft 243 is mounted in a pivot shaft hole 216 formed on the first housing 211 and the second housing 212 of the locking body 21, so that the lock latch 24 is pivotable about the pivot shaft 243 in the cavity surrounded by the first housing 211 and the second housing 212. The first body 241 has a hook portion 244 at a first end 249 thereof away from the pivot shaft 243, the hook portion can extend out of or retract into the locking body housing based on the pivoting motion, and the hook portion 244 can form engagement with the locking plate 22 when the hook portion 244 extends out of the locking body housing. Preferably, a reinforcing rib 248 may be provided at the hook portion 244. The second body 242 has a receiving portion 245 at a position thereof away from the pivot shaft 243 and adjacent to a second end 250, and the receiving portion may be used to receive a first magnet 25 (not shown in the figure). The receiving portion 245 is shown as a square here, but it may be various shapes matching the first magnet 25 in size. When the lock latch 24 pivots about the pivot shaft 243, the receiving portion may move into or move away from the receiving indentation 214 formed in the mounting base of the locking body 21 along with the pivoting motion of the locking latch 24, and the receiving indentation may be a blind hole or a through hole (see FIG. 3 and FIG. 4). As shown in FIG. 4, a groove 28 for receiving a second magnet 26 (not shown in the figure) is provided in the locking body housing, and adjacent to the pivot shaft hole, corresponding to the position of the pivot shaft 243. When the locking mechanism is in the non-active state, i.e., when the slide bar 27 of the locking mechanism does not limit the pivoting of the lock latch 24 (the action manner thereof will be described below in detail), attraction force between the second magnet 26 and first magnet 25 enables the lock latch 24 to pivot about the pivot shaft 243 counterclockwise, the receiving portion moves away from the receiving indentation 214 and meanwhile hook portion 244 extends out of the locking body housing and engages with the locking plate 22; while the slide bar switch 27 displaces to switch the locking mechanism to its active state, the lock latch 24, abutted and pressed by a wedge-shaped portion 271 of the slide bar switch 27 of the locking mechanism, overcomes the attraction force between the second magnet 26 and first magnet 25. At the same time, the lock latch 24 pivots about the pivot shaft 244 clockwise, the receiving portion enters the receiving indentation 214, and the hook portion 244 retracts in the locking body housing. To facilitate implementation of the linkage of the lock latch 24 and the slide bar switch 27, preferably a protruding rod 246 is provided at the second end 250 of the second body 242, and it can bring the lock latch 24 to pivot about the pivot shaft 243 according to the displacement of the slide bar switch 27 due to the action of the wedge-shaped portion 271 of the slide bar switch 27.

Figure 7:
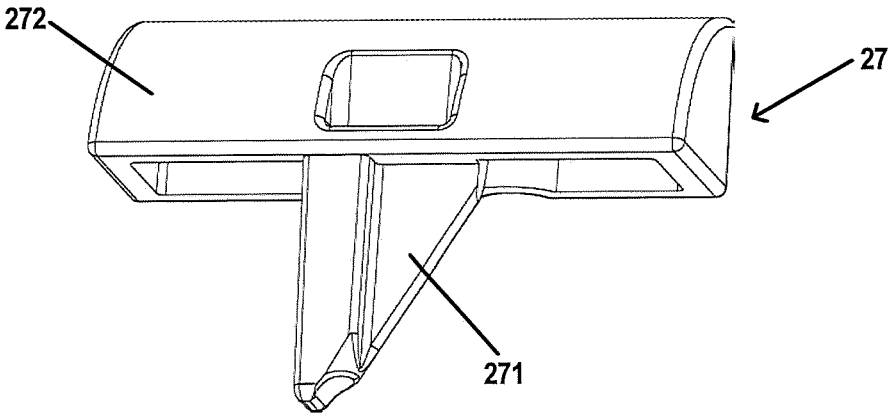
FIG. 7 shows a perspective view of a slide bar switch of a locking mechanism of the locking body assembly according to the present invention.
Figure 8A:
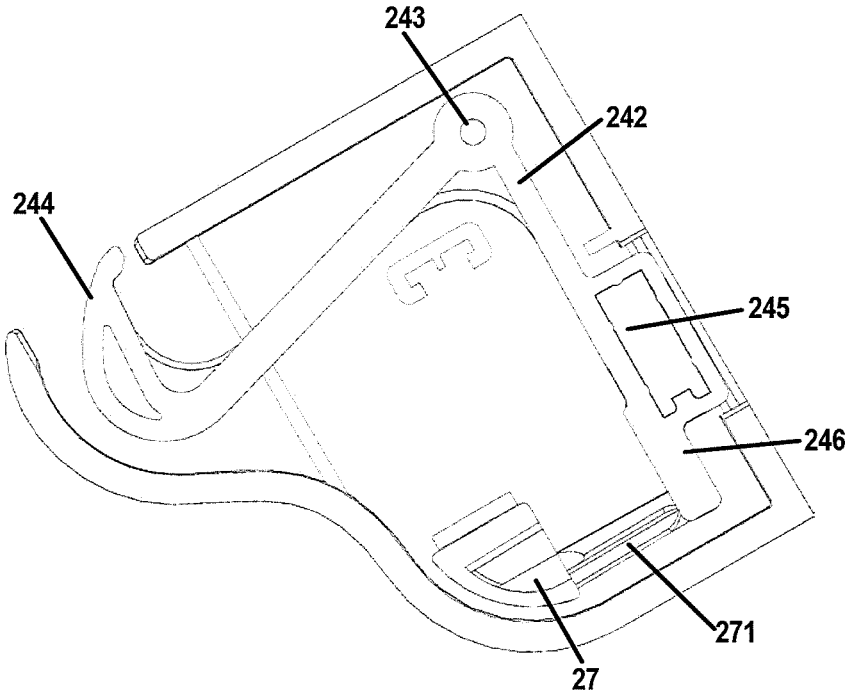
FIGS. 8A and 8B respectively show a sectional view of the locking mechanism of the locking body assembly according to the present invention in an unlocked state and a locked state.
Figure 8B:
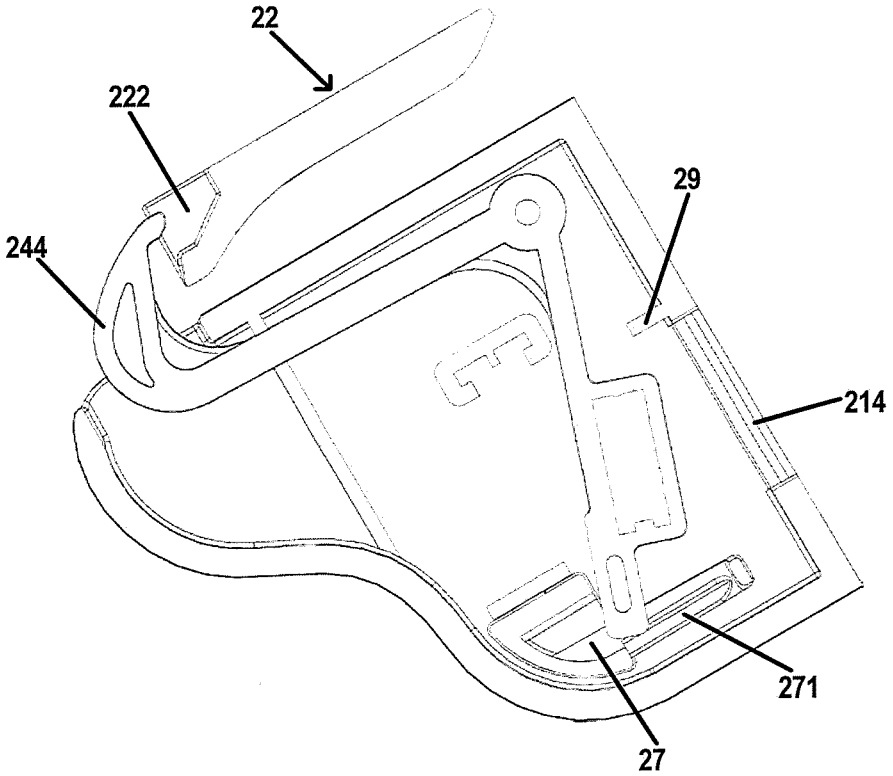

Referring to FIG. 7, the slide bar switch 27 according to the present invention comprises a slide bar portion 272 and a wedge-shaped portion 271 located in the middle of the slide bar portion 272. A first end and a second end of the slide bar portion 272 can respectively pass through a slide bar switch hole 215 on the first housing 211 and the second housing 212. When the first end of the slide bar switch is pressed in the housing, the second end of the slide bar switch extends out of the housing, and the locking mechanism is in the non-active state; when the second end of the slide bar switch is pressed in the housing, the first end of the slide bar switch extends out of the housing and the locking mechanism is in the active state. More specifically, when the second end of the slide bar switch is pressed, as the slide bar portion 272 of the slide bar switch 27 slides leftward (see FIG. 2 and FIG. 5), the wedge-shaped portion 271 abuts against the rod 246 at the second end 250 of the second body 242 of the lock latch 24 and gradually presses downward, thereby overcoming the attraction force between the second magnet 26 and the first magnet 25, so that the lock latch 24 is enabled to pivot about the pivot shaft 243 in the counterclockwise direction in FIG. 8A, the receiving portion enters the receiving indentation 214, and the hook portion 244 retracts into the housing of the locking body. FIG. 8A shows a state, namely, an unlocked state, of the locking body assembly at this time. When the first end of the slide bar switch is pressed, as the slide bar portion 272 of the slide bar switch 27 slides rightward (see FIG. 2 and FIG. 5), the wedge-shaped portion 271 gradually disengages from the rod 246 at the second end 250 of the second body 242 of the lock latch 24, the attraction force between the second magnet 26 and the first magnet 25 enables the lock latch 24 to pivot about the pivot shaft 243 in the clockwise direction as shown in FIG. 8B, the receiving portion 245 gets away from the receiving indentation 214, and the hook portion 244 extends out of the locking body and engages with the locking plate. FIG. 8B shows a state, namely, a locked state of the locking body assembly at this time. In this state, the unlocking is achieved through the sliding of the slide bar switch 27 or by using the key 1.

In addition, at a position in the cavity of the locking body 21 and adjacent to the receiving indentation 214 may be provided a stop portion 29 which is used to stop further movement of the second body 242 of the lock latch 242 when the receiving portion 245 moves towards the receiving indentation 214 due to the pivoting of the lock latch 24, thereby preventing the receiving portion 245 together with the magnet 25 therein from protruding out of a space-leaving portion and causing damages to the surface of the furniture on this side.

Figure 9:
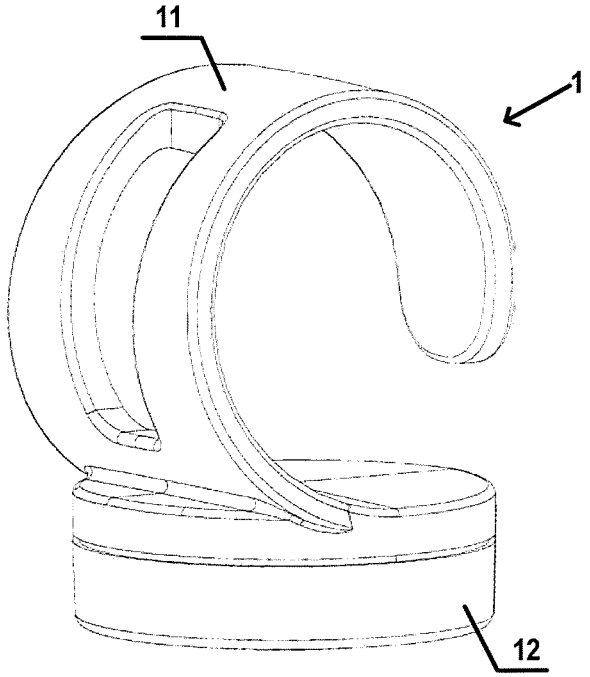
FIG. 9 shows a perspective view of a key according to an embodiment of the present invention.
Figure 10:
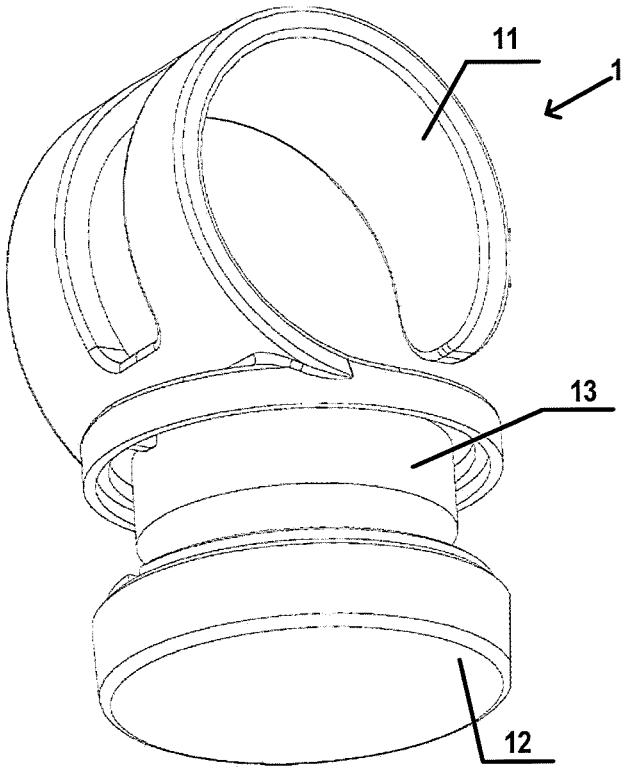
FIG. 10 shows an exploded view of a key according to an embodiment of the present invention.

FIG. 9 shows a perspective view of the key 1 according to the present invention, and FIG. 10 shows an exploded view of the key 1 according to the present invention. The key 1 according to the present invention may comprise a gripping portion 11, a base 12 and a key magnet 13 received in the base 12. An attraction action between the key magnet 13 and the first magnet 25, when the two are close enough, is larger than the attraction action between the first magnet 25 and the second magnet 26. Therefore, when the key magnet 13 approaches the first magnet 25, the larger magnetic attraction action enables the first magnet 25 to pivot against the attraction force between it and the second magnet 26, so that the hook portion 244 disengages from the locking plate 22 and retracts into the cavity, thereby achieving the unlocking of the locking body assembly 2. However, those skilled in the art may appreciate that the key 1 may be a magnet without other parts.

Preferably, the locking plate 22, the lock latch 24, the slide bar switch 27, the gripping portion 11 and the base 12 according to the present invention may be made of plastic.

Through the above content, those skilled in the art can readily recognize that alternative structures for the structures disclosed in the present invention may be used as feasible alternative embodiments, and the embodiments disclosed in the present invention may be combined to generate new embodiments, which all fall within the scope as defined in the appended claims.

What is claimed is:

1. A locking mechanism for a magnetic lock, comprising a locking body, the locking body comprising a lock latch having a first magnet and a pivot shaft, a slide bar switch operatively associated with the lock latch for selectively disengaging the lock latch, and a second magnet; wherein the lock latch is configured to disengage from the slide bar switch when a first end of the slide bar switch is pressed horizontally to a longitudinal axis of the pivot shaft and slides towards the locking body, to provide the locking mechanism in a non-active state, where the lock latch can pivot about the pivot shaft due to a magnetic force action between the first and second magnets, so that the magnetic lock can be locked and unlocked; and wherein, the locking mechanism is configured to move to an active state when a second end of the slide bar switch is pressed horizontally to a longitudinal axis of the pivot shaft and slides towards the locking body, with the slide bar switch abutting and pressing against the lock latch, making the lock latch pivot about the pivot shaft reversely against the magnetic force action between the first magnet and the second magnet, and with the magnetic lock remaining in an unlocked position.

2. The locking mechanism according to claim 1, wherein the slide bar switch includes a blocking member such that pressing of the first end of the slide bar switch provides the blocking member in a position where it interferes with the movement of the lock latch to maintains the lock latch in the inactive position so that the magnetic lock cannot be locked, wherein pressing of the second end of the slide bar switch moves the blocking member out of interference with the movement of the lock latch so that the lock latch is enabled to move to the active position to lock the magnetic lock.

3. The locking mechanism of claim 2, wherein when the blocking member is out of interference with the movement of the lock latch and the lock latch locks the magnetic lock, the magnetic lock can be opened using an external key that includes a magnet.

4. The locking mechanism according to claim 1, wherein the lock latch is an L-shaped member.

5. The locking mechanism according to claim 4, wherein the lock latch comprises a first body, a second body and a pivot shaft between the first body and the second body.

6. The locking mechanism according to claim 5, wherein the lock latch includes a hook portion at a first end thereof, and a protruding rod at a second end, and with a receiving portion for receiving the first magnet located adjacent the second end.

7. The locking mechanism according to claim 6, wherein the slide bar switch comprises a slide bar portion and the blocking member, and wherein the blocking member is a wedge-shaped location in the middle of the slide bar portion.

8. The locking mechanism according to claim 4, wherein the second magnet is arranged nearby the pivot shaft of the lock latch.

9. The locking mechanism according to claim 7, wherein when the latch is disengaged from the slide bar switch, an attraction force between the second magnet and the first magnet enables the lock latch to pivot about the pivot shaft to the unlocked position.

10. The locking mechanism according to claim 7, wherein movement of the second end of the slide bar switch overcomes an attraction force between the second magnet and the first magnet, so that the lock latch can pivot about the pivot shaft reversely to move the lock latch to the locked position.

11. A locking body assembly for a magnetic lock comprising the locking body and a locking plate, with the locking body comprising a locking body housing, and with the locking plate disposed outside the locking body housing, and the locking mechanism according to claim 1 disposed in the locking body housing.

12. The locking body assembly according to claim 11, wherein the locking body has a mounting base that includes a centrally mounted receiving indentation, and with a stop portion adjacent the receiving indentation, with the receiving indentation optionally being a blind hole or a through hole.

13. The locking body assembly according to claim 11, wherein the locking body housing comprises a slide bar switch hole and a pivot shaft hole for engaging the pivot shaft.

14. The locking body assembly according to claim 11, wherein the locking body housing comprises a first housing and a second housing, with the first and second housings combined to form a cavity for receiving the locking mechanism.

15. The locking body assembly according to claim 11, wherein the locking body housing includes a groove for receiving the second magnet with the groove positioned adjacent the pivot shaft hole, and with the locking plate including a recess or rod for engagement.

16. The locking body assembly according to claim 11, wherein the locking plate includes a base surface mounted on a surface in an interior of furniture, and the locking body is, via its mounting base, mounted on a plane at a right angle relative to the locking plate.

17. The locking body assembly according to claim 14, wherein the first housing, the second housing and the locking plate can each be mounted on a door of the furniture via screw connection or adhesion.

18. The locking body assembly according to claim 11, wherein the lock latch includes a hook portion and includes a reinforcing rib at the hook portion.

19. A magnetic lock, comprising a key and the locking body assembly according to claim 11.

20. The magnetic lock according to claim 15, wherein the key comprises a key magnet, a gripping portion and a base for receiving the key magnet.

* * * * *